US012139993B1

(12) United States Patent
Wang et al.

(10) Patent No.: US 12,139,993 B1
(45) Date of Patent: Nov. 12, 2024

(54) MULTIFUNCTIONAL ROTATING CONTROL DEVICE

(71) Applicant: Unifusion Intelligent Technology Co. Ltd, Chengdu (CN)

(72) Inventors: Chunlei Wang, Chengdu (CN); Qiang Zhao, Chengdu (CN); Bo Kang, Chengdu (CN); Wei Zhang, Chengdu (CN); Qijun Zeng, Chengdu (CN)

(73) Assignee: Unifusion Intelligent Technology Co. Ltd, Chengdu (CN)

( * ) Notice: Subject to any disclaimer, the term of this patent is extended or adjusted under 35 U.S.C. 154(b) by 0 days.

(21) Appl. No.: 18/635,020

(22) Filed: Apr. 15, 2024

(51) Int. Cl.
*E21B 33/08* (2006.01)

(52) U.S. Cl.
CPC ..... *E21B 33/085* (2013.01)

(58) Field of Classification Search
CPC ..... E21B 33/085
See application file for complete search history.

(56) References Cited

U.S. PATENT DOCUMENTS 2,021,104 A * 11/1935 Kinnear ..... E21B 33/085 166/86.2
2,207,149 A * 7/1940 Hild ..... E21B 33/085 175/218
8,286,734 B2 * 10/2012 Hannegan ..... E21B 33/068 166/84.1
10,961,795 B1 * 3/2021 Parker ..... E21B 21/08
2009/0139724 A1 * 6/2009 Gray ..... E21B 23/04 166/345
2015/0330205 A1 * 11/2015 Ring ..... E21B 21/08 166/336

* cited by examiner

*Primary Examiner* — James G Sayre
(74) *Attorney, Agent, or Firm* — Bayramoglu Law Offices LLC

(57) ABSTRACT

A multifunctional rotating control device (RCD) is provided. The multifunctional RCD includes an RCD assembly and a flow detection module. Further, the RCD assembly includes a body and a rotating sealing assembly. A bore through hole and a bypass outlet are formed in the body, and the rotating sealing assembly is provided in the bore through hole. Additionally, the bypass outlet is connected to a straight-through cut-off valve, and the flow detection module includes a flowmeter, a first flow cut-off valve, and a second flow cut-off valve. Further, the flowmeter extends upward in a direction of the bore through hole, and the first flow cut-off valve and the second flow cut-off valve are respectively provided at two ends of the flowmeter, and communicate with the flowmeter. Additionally, an inlet of the flowmeter is a flow detection input outlet, and the flow detection input outlet communicates with the straight-through cut-off valve.

18 Claims, 12 Drawing Sheets

MULTIFUNCTIONAL ROTATING CONTROL DEVICE

TECHNICAL FIELD

The present disclosure relates to the technical field of pressure control in drilling and completion, and in particular to a multifunctional rotating control device (RCD).

BACKGROUND

In drilling and completion, a complex pressure stratum of an oil-gas well is prone to downhole gas invasion, overflow, leakage, displacement and other complex accidents due to a narrow density window. This greatly increases non-productive time to cause a long drilling period and a high cost. Technical methods such as annular borehole sealing and downhole multiphase fluid measurement are required to prevent and control the accidents. Components such as an RCD and a metering manifold are usually used. According to a prior art, the RCD is provided at a wellhead, and the metering manifold is provided on the ground far away from the wellhead. All key devices are functionally independent of each other, and are connected through a long high pressure line to form processes and systems. Consequently, the system has a low integration level, a complex site layout, a long installation and debugging period, a high cost, and hard maintenance.

SUMMARY

The present disclosure provides a multifunctional RCD, to solve one of the existing technical problems.

The present disclosure uses the following technical solutions: A multifunctional RCD includes an RCD assembly and a flow detection module, where the RCD assembly includes a body and a rotating sealing assembly; a bore through hole and a bypass outlet are formed in the body; the rotating sealing assembly is provided in the bore through hole; and the bypass outlet is connected to a straight-through cut-off valve; and the flow detection module includes a flowmeter, a first flow cut-off valve, and a second flow cut-off valve; the flowmeter extends upward in a direction of the bore through hole; the first flow cut-off valve and the second flow cut-off valve are respectively provided at two ends of the flowmeter, and communicate with the flowmeter; an inlet of the flowmeter is a flow detection input outlet; the flow detection input outlet communicates with the straight-through cut-off valve; and an outlet of the second flow cut-off valve is a flow detection output outlet.

The present disclosure has the following working principle and the following beneficial effects: The flowmeter extends upward in the direction of the bore through hole. That is, the whole flow detection module is integrated onto the RCD assembly, and extends upward in the direction of the bore through hole. The flow detection module has a small occupied space in a horizontal direction of the RCD assembly, and a main occupied space extending upward in the direction of the bore through hole. Therefore, the whole RCD has a small occupied space and a compact structure.

The present disclosure may further make the following improvement based on the above technical solution.

Further, the first flow cut-off valve and the second flow cut-off valve are opposite to each other; and a double-output actuator is provided between the first flow cut-off valve and the second flow cut-off valve and configured to drive one of the first flow cut-off valve and the second flow cut-off valve to turn on and the other of the first flow cut-off valve and the second flow cut-off valve to turn off.

The above further solution has the following beneficial effects: The double-output actuator drives one of the first flow cut-off valve and the second flow cut-off valve to turn on and the other of the first flow cut-off valve and the second flow cut-off valve to turn off, such that one actuator controls two cut-off valves. This reduces product components, and improves a control efficiency.

The present disclosure may further make the following improvement based on the above technical solution.

Further, the double-output actuator has an electric driving structure.

The above further solution has the following beneficial effects: The electric driving structure realizes electric control, and can realize remote and automatic control.

The present disclosure may further make the following improvement based on the above technical solution.

Further, a manual driving mechanism is further provided on the electric driving structure.

The above further solution has the following beneficial effects: The manual driving mechanism is provided. In case of a failure or a fault of the electric driving structure, the manual driving mechanism can be used for operation to ensure normal work of the system.

Further, the multifunctional RCD further includes a compression mechanism for compressing the rotating sealing assembly; and the compression mechanism is provided on the body.

The above further solution has the following beneficial effects: The rotating sealing assembly is compressed in the bore through hole of the body through the compression mechanism to ensure reliable compression.

The present disclosure may further make the following improvement based on the above technical solution.

Further, the compression mechanism includes a compression part and a driving mechanism; and the driving mechanism drives the compression part to extend out of an inner surface of the body or retract into the body.

The above further solution has the following beneficial effects: The driving mechanism drives the compression part to extend out of the inner surface of the body or retract into the body. That is, one driving mechanism drives a plurality of compression parts.

The present disclosure may further make the following improvement based on the above technical solution.

Further, the driving mechanism includes a single-output actuator and a transmission mechanism; the transmission mechanism includes a pinion, a swing gear, and cone gears; an output shaft of the single-output actuator is fixedly connected to the pinion; the swing gear is sleeved on an outer side of the body; an external gear in transmission connection with the pinion is provided at an outer side of the swing gear; a bevel gear in transmission connection with a plurality of the cone gears is provided on a top of the swing gear; and the cone gears each are in screwed driving connection with the compression part.

The above further solution has the following beneficial effects: Through the transmission mechanism including the pinion, the swing gear, and the cone gear, gear transmission from the output shaft of the actuator to the cone gear is realized to ensure the reliable transmission.

The present disclosure may further make the following improvement based on the above technical solution.

Further, a first bearing is fixedly provided on the body; and the first bearing includes an inner race fixedly connected to the body, and an outer race being the swing gear.

The above further solution has the following beneficial effects: The outer race of the first bearing serves as the swing gear. By skillfully providing the gear on the outer race, the whole transmission device has less components.

The present disclosure may further make the following improvement based on the above technical solution.

Further, one end of the compression part is provided with an outer thread; the cone gear is provided with an inner thread, and fixedly connected to the body through a second bearing; and the outer thread and the inner thread are engaged and are in screwed driving connection.

The above further solution has the following beneficial effects: With thread engagement and the second bearing, the compression part is driven to move in a radial direction of the body, with a high reliability.

The present disclosure may further make the following improvement based on the above technical solution.

Further, the other end of the compression part passes through the body and is slidably connected to the body.

The above further solution has the following beneficial effects: The compression part is slidably connected to the body to provide desirable supporting and guiding effects.

The present disclosure may further make the following improvement based on the above technical solution.

Further, a non-circular hole is formed in the body; and the compression part is provided with a structure matching with the non-circular hole and slidably connected to the structure.

The above further solution has the following beneficial effects: Through a guiding hole of a non-circular hole structure, rotation of the compression part in a circumferential direction of the guiding hole is prevented.

The present disclosure may further make the following improvement based on the above technical solution.

Further, there are a plurality of compression parts that are equally spaced in a circumferential direction of the body.

The above further solution has the following beneficial effects: The plurality of compression parts provide a larger compressing force. The plurality of compression parts are equally spaced, which facilitates equalization of a pressure, and makes compression more reliable.

REFERENCE NUMERALS

Figure 1:
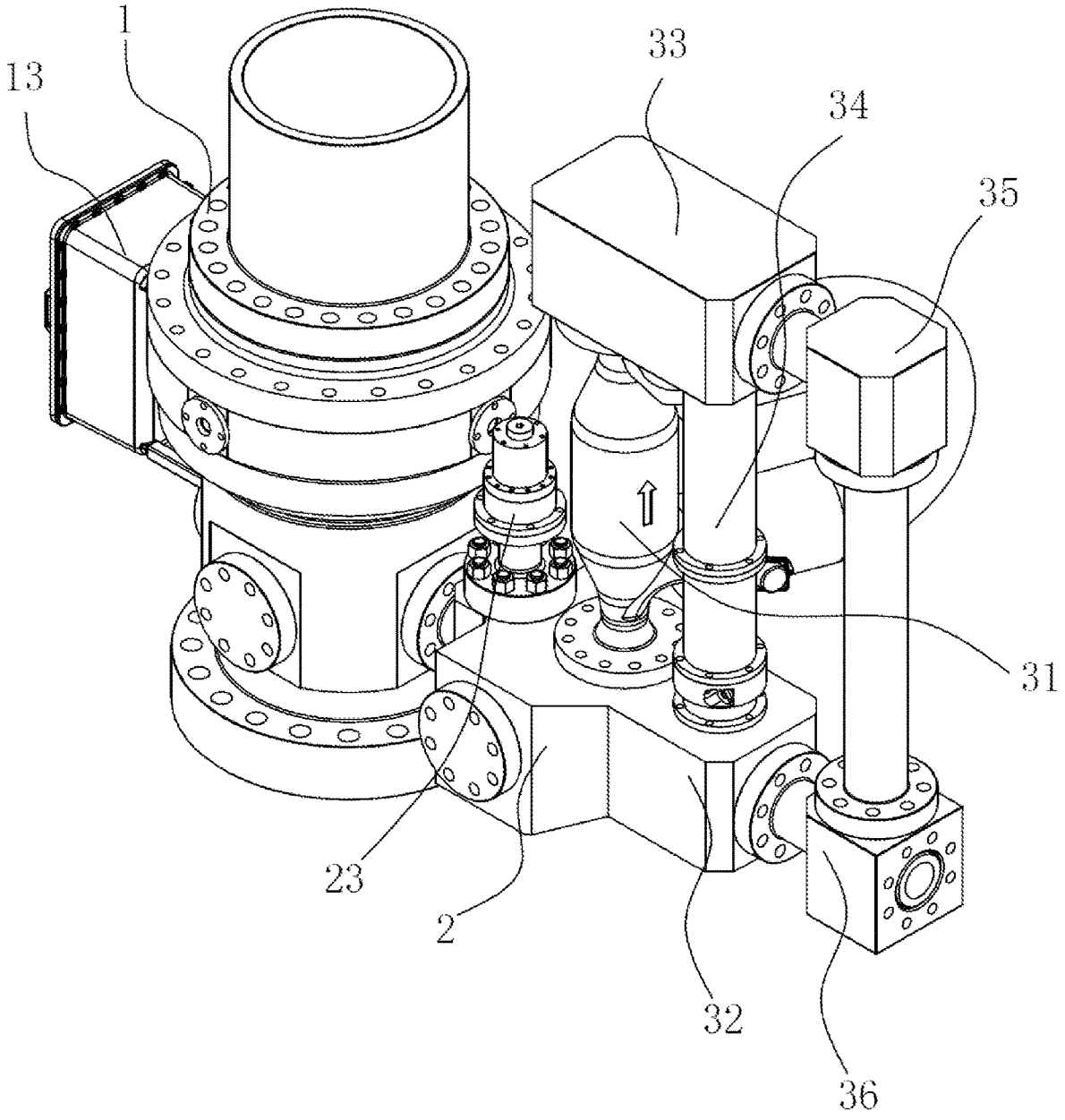
FIG. 1 is a stereoscopic structural schematic view of a multifunctional RCD according to Embodiment 1 of the present disclosure.
Figure 2:
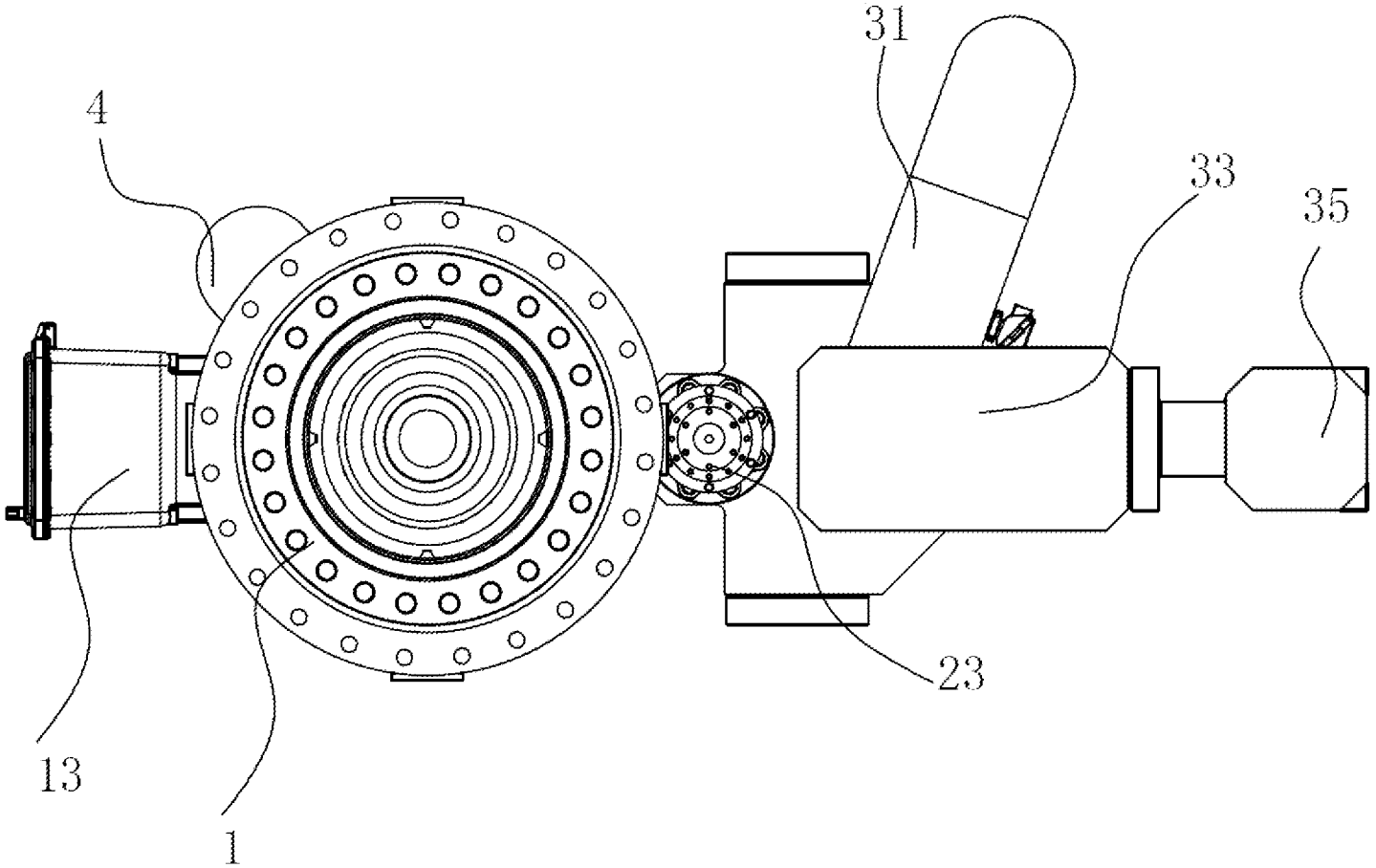
FIG. 2 is a view in a first direction according to Embodiment 1.
Figure 3:
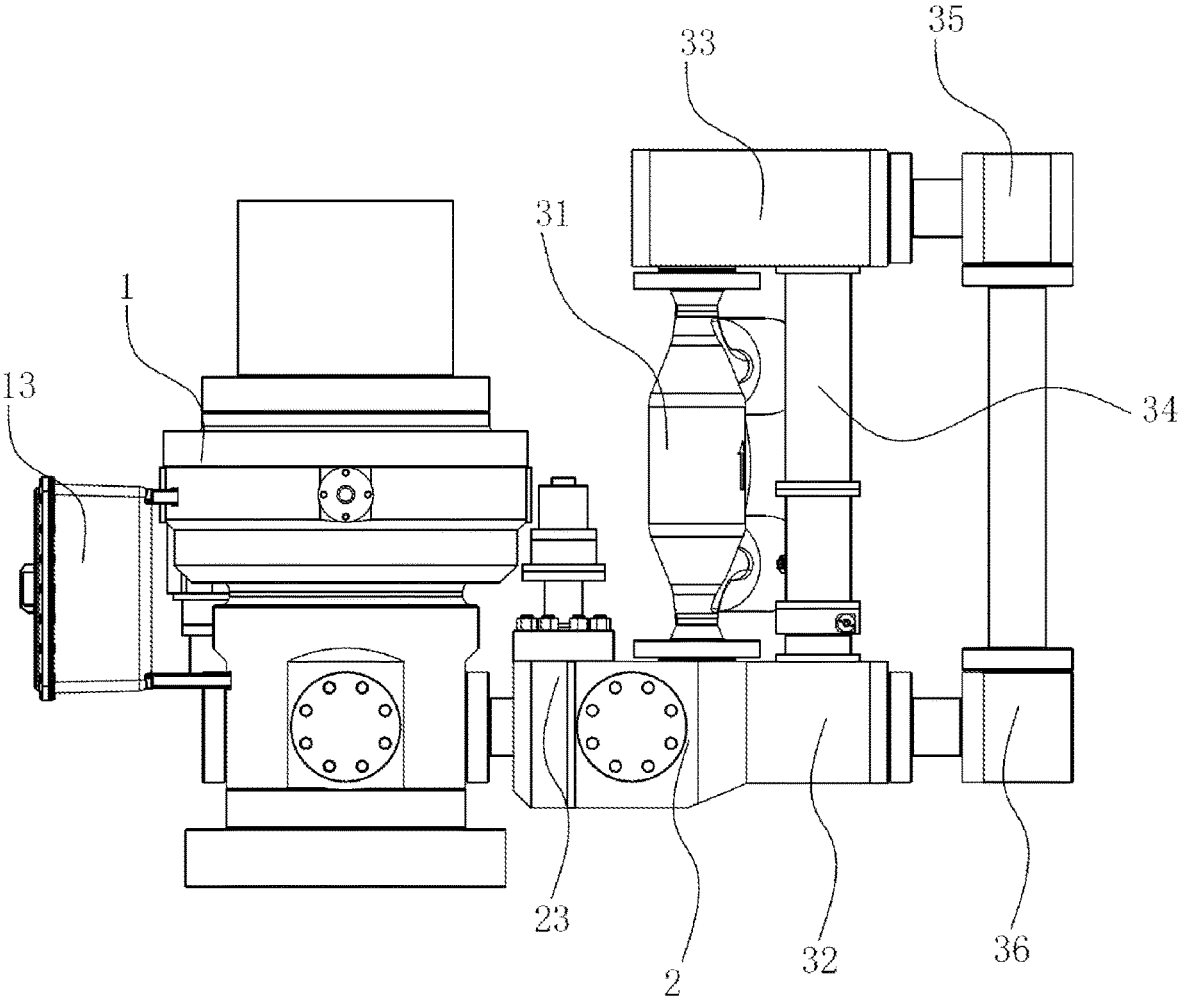
FIG. 3 is a view in another direction according to Embodiment 1.
Figure 4:
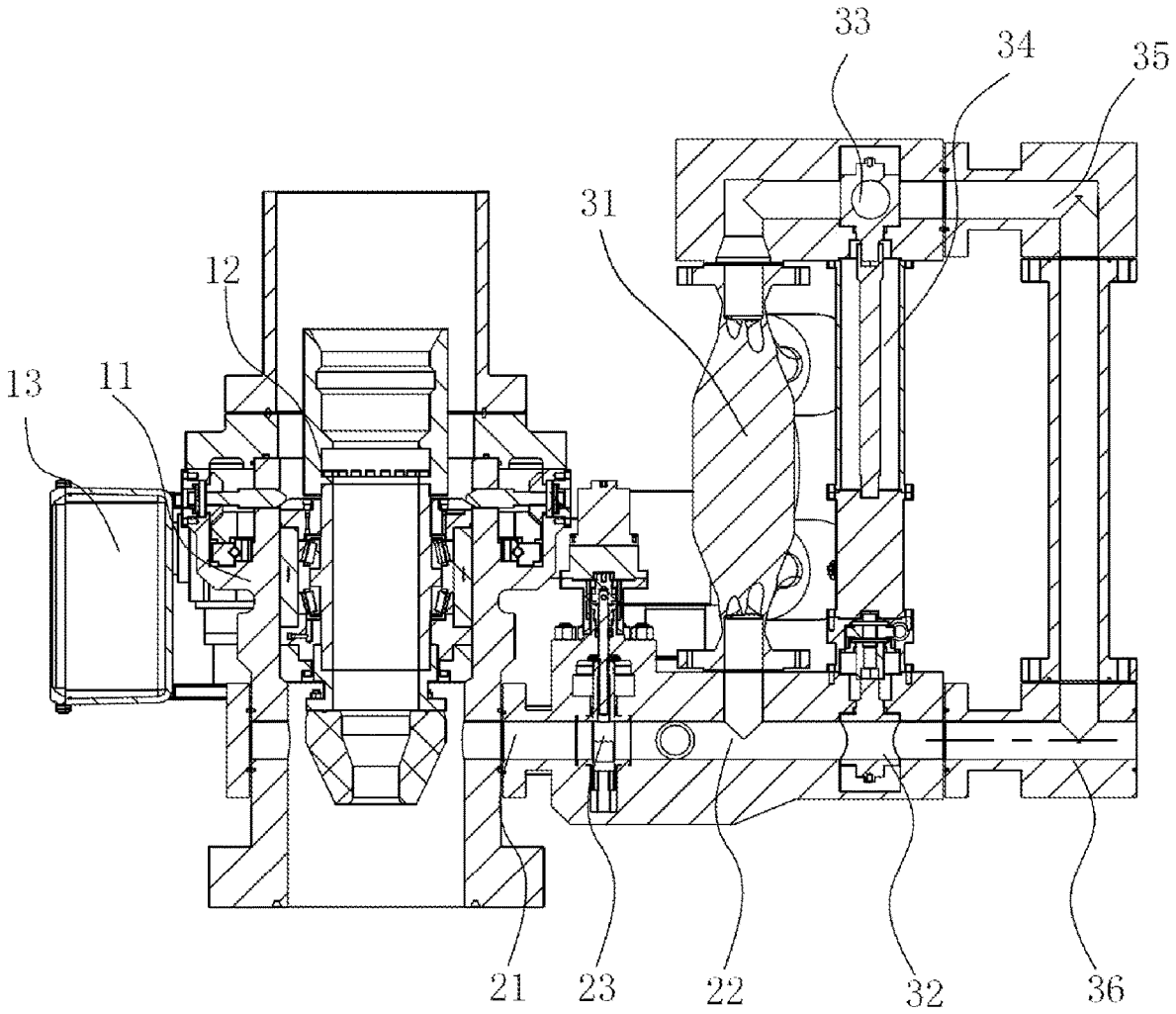
FIG. 4 is a sectional view in one direction according to Embodiment 1.
Figure 5:
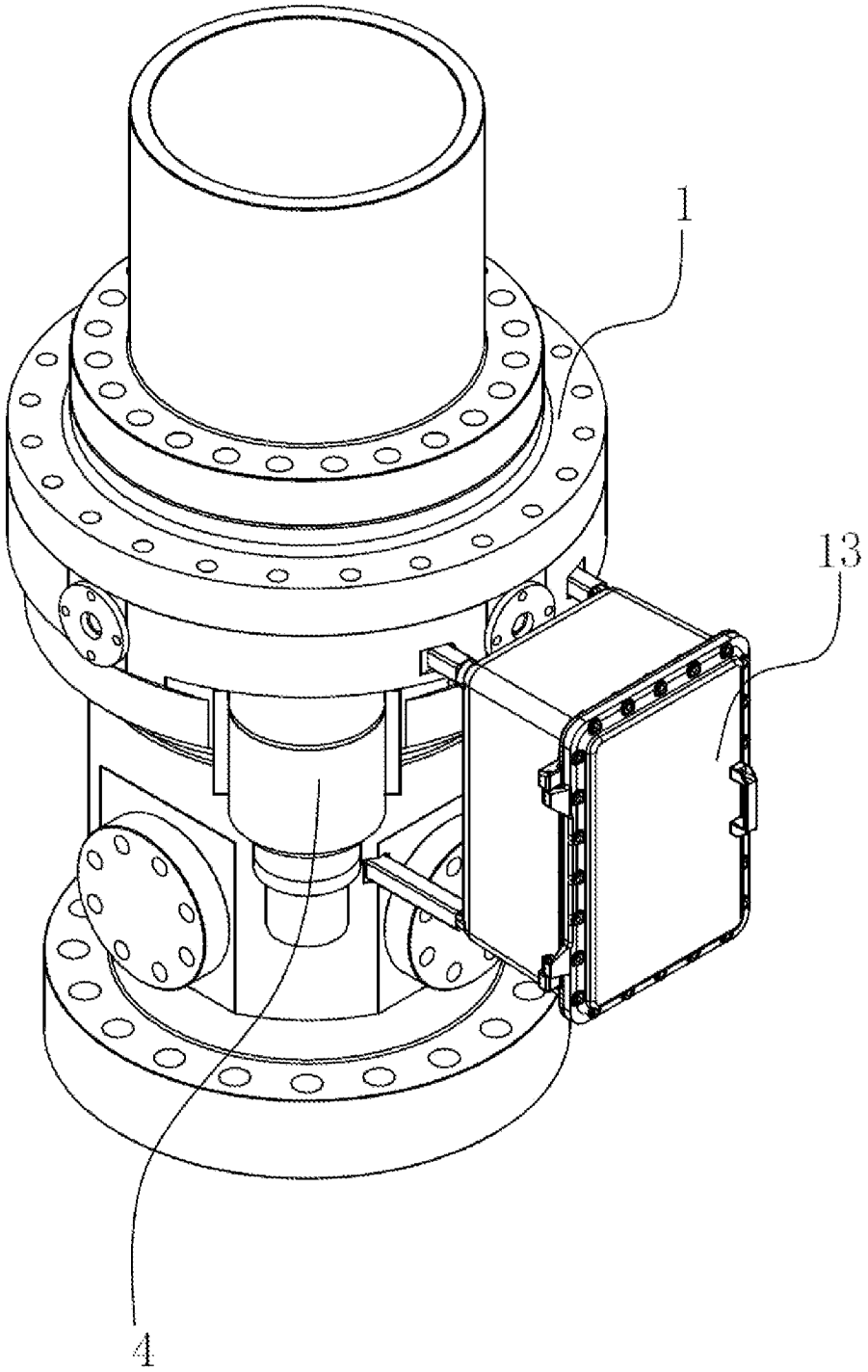
FIG. 5 is a stereoscopic structural schematic view of an RCD assembly according to Embodiment 1.
Figure 6:
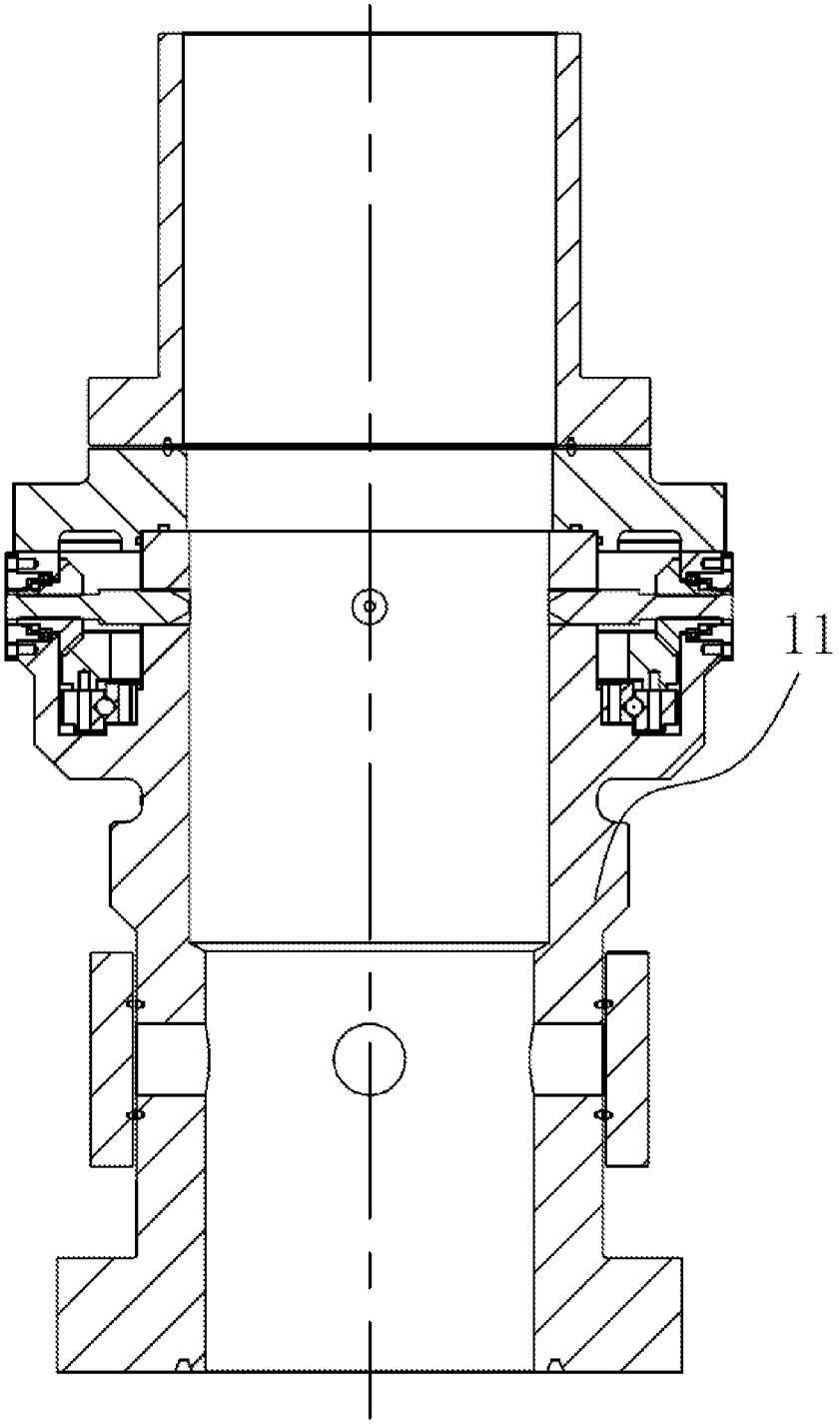
FIG. 6 is a sectional view of a body according to Embodiment 1.
Figure 7:
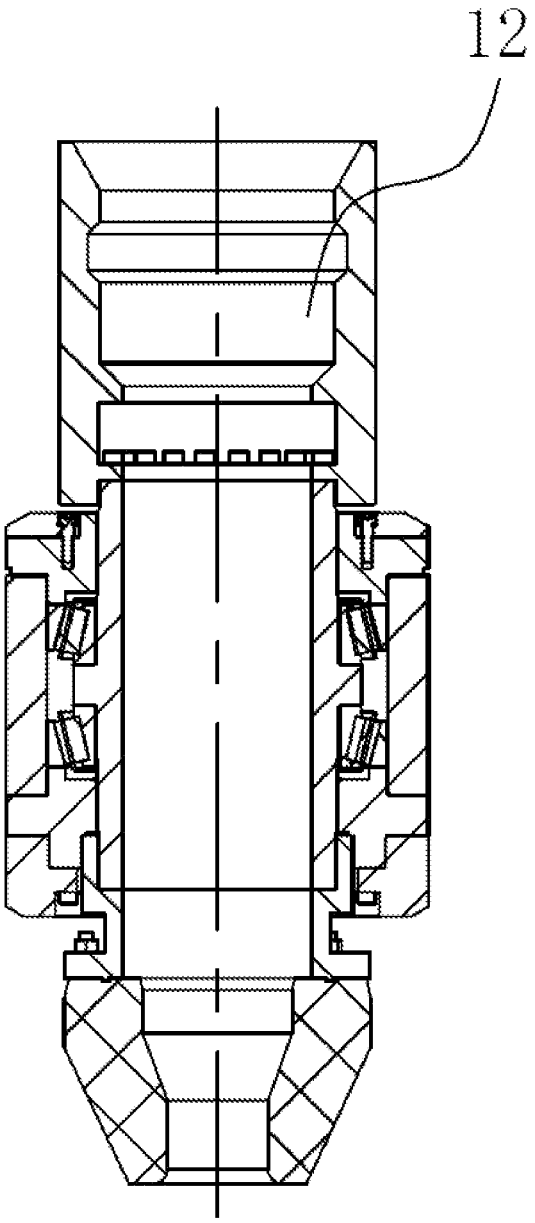
FIG. 7 is a sectional view of a rotating sealing assembly according to Embodiment 1.
Figure 8:
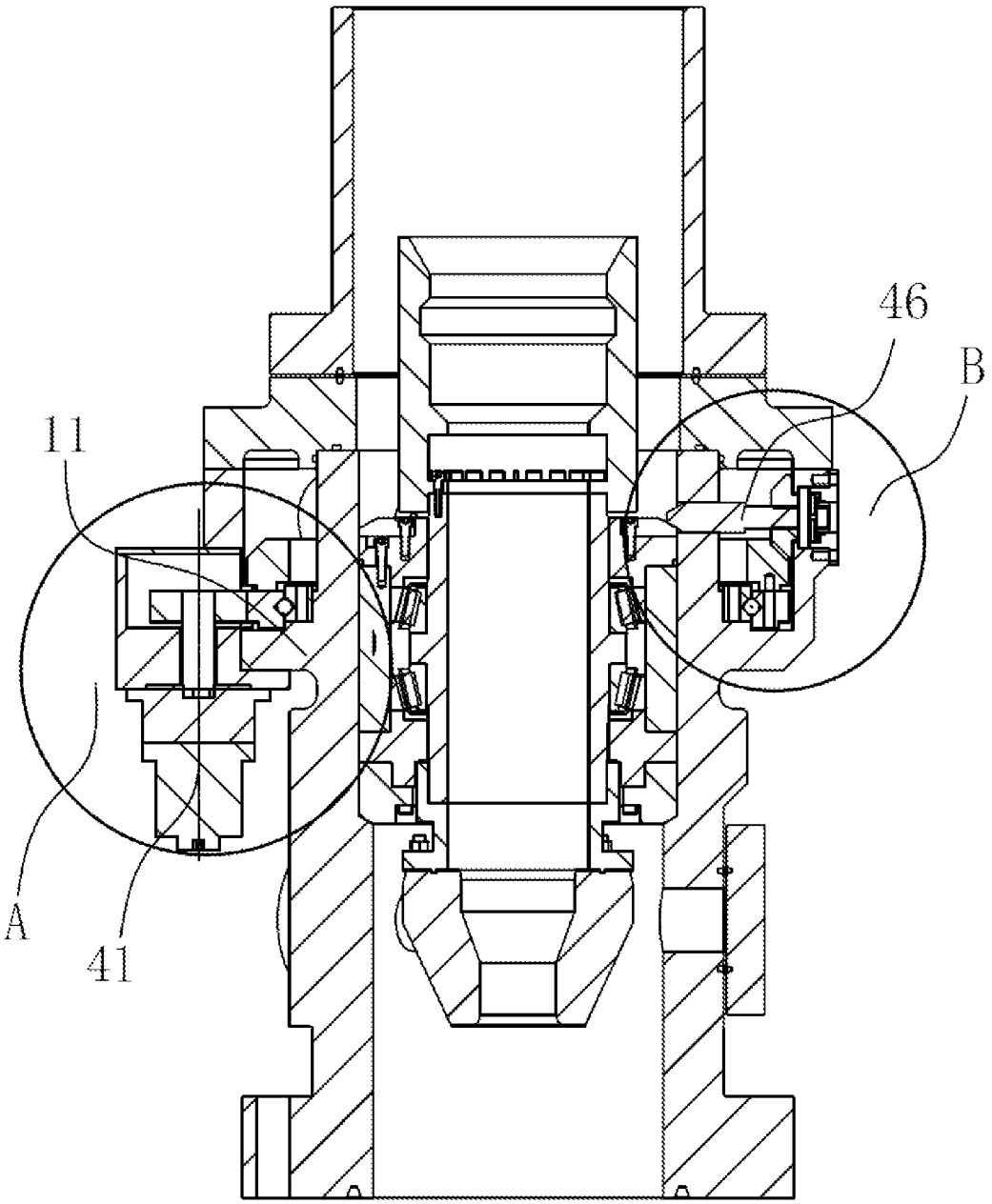
FIG. 8 is a sectional view of an RCD assembly according to Embodiment 1.

1: RCD assembly, 11: body, 12: rotating sealing assembly, 13: control pod, 2: connector, 21: first outlet, 22: second outlet, 23: straight-through cut-off valve, 31: flowmeter, 32: first flow cut-off valve, 33: second flow cut-off valve, 34: double-output actuator, 35: right-angle connector, 36: three-way connector, 4: compression mechanism, 41: single-output actuator, 42: pinion, 43: swing gear, 44: bevel gear, 45: cone gear, 46: compression part, and 47: second bearing.

DETAILED DESCRIPTION OF THE EMBODIMENTS

The principles and features of the present disclosure are described below with reference to the accompanying drawings. The listed examples are only used to explain the present disclosure, rather than to limit the scope of the present disclosure.

FIG. 1 to FIG. 10 illustrate a structural schematic view of a multifunctional RCD according to Embodiment 1 of the present disclosure.

A multifunctional RCD includes RCD assembly 1, connector 2, and a flow detection module. The RCD assembly 1 includes body 11 and rotating sealing assembly 12. A bore through hole and a bypass outlet are formed in the body 11. The rotating sealing assembly 12 is provided in the bore through hole. The bypass outlet is connected to a straight-through cut-off valve. The straight-through cut-off valve is provided on the connector 2. That is, the straight-through cut-off valve is provided adjacent to first outlet 21. The first outlet 21 of the connector 2 is connected to the bypass outlet. Control pod 13 for controlling the multifunctional RCD is provided at a side of the body 11 opposite to the connector 2. That is, a control module is provided in the control pod 13. The control module is electrically connected to the flow detection module, the straight-through cut-off valve 23, double-output actuator 34, and single-output actuator 41. In other words, the control module controls on-off of each valve in the flow detection module, controls on-off of the straight-through cut-off valve 23, and controls the power output of the single-output actuator 41. The compression action of a compression mechanism on the RCD and the release action of the rotating sealing assembly are driven by the single-output actuator 41. The flow detection module is provided at a second outlet 22 end of the connector 2, and communicated to the second outlet 22. Specifically, the flow detection module includes flowmeter 31, first flow cut-off valve 32, and second flow cut-off valve 33. The flowmeter 31 extends upward in a direction of the bore through hole, namely in an upward direction in the figure. The first flow cut-off valve 32 and the second flow cut-off valve 33 are respectively provided at two ends of the flowmeter 31, and communicate with the flowmeter 31. An inlet of the flowmeter 31 is a flow detection input outlet. The flow detection input outlet is provided at the second outlet 22 end. An outlet of the second flow cut-off valve 33 is a flow detection output outlet. As shown in the figure, the first flow cut-off valve 32 and the second flow cut-off valve 33 are opposite to each other in a direction shown in the figure. The double-output actuator 34 is provided between the first flow cut-off valve 32 and the second flow cut-off valve 33 and configured to drive one of the first flow cut-off valve 32 and the second flow cut-off valve 33 to turn on and the other of the first flow cut-off valve and the second flow cut-off valve to turn off. Right-angle connector 35 is provided at the outlet of the second flow cut-off valve 33. The right-angle connector 35 is connected to an outlet of the first flow cut-off valve 32 through three-way connector 36.

The double-output actuator 34 drives one of the first flow cut-off valve 32 and the second flow cut-off valve 33 to turn on and the other of the first flow cut-off valve and the second flow cut-off valve to turn off. That is, when flow detection is to be performed on a fluid, the double-output actuator 34 turns off the first flow cut-off valve 32, and turns on the second flow cut-off valve 33. Through the flowmeter 31, the fluid flows out from an output end of the second flow cut-off valve 33 and finally flows out through the three-way connector 36, thereby realizing the flow detection on the fluid.

When the flow detection is not required, the double-output actuator 34 turns on the first flow cut-off valve 32, and turns off the second flow cut-off valve 33. The flow does not pass through the flowmeter 31, and directly flows out from the first flow cut-off valve 32, then flows out from an output end of the three-way connector 36.

Referring to FIG. 3, FIG. 5 to FIG. 9, the multifunctional RCD in the embodiment further includes compression mechanism 4 for compressing the rotating sealing assembly 12. The compression mechanism 4 is provided on the body 11. The compression mechanism 4 includes a compression part 46 and a driving mechanism. The driving mechanism drives the compression part 46 to extend out of an inner surface of the body 11 or retract into the body 11.

The driving mechanism includes the single-output actuator 41 and a transmission mechanism. The transmission mechanism includes pinion 42, swing gear 43, and cone gears 45. An output shaft of the single-output actuator 41 is fixedly connected to the pinion 42. The swing gear 43 is sleeved on an outer side of the body 11. An external gear in transmission connection with the pinion 42 is provided at an outer side of the swing gear 43. Bevel gear 44 in transmission connection with a plurality of the cone gears 45 is provided on a top of the swing gear 43. The cone gears 45 each are in screwed driving connection with the compression part 46.

Figure 9:
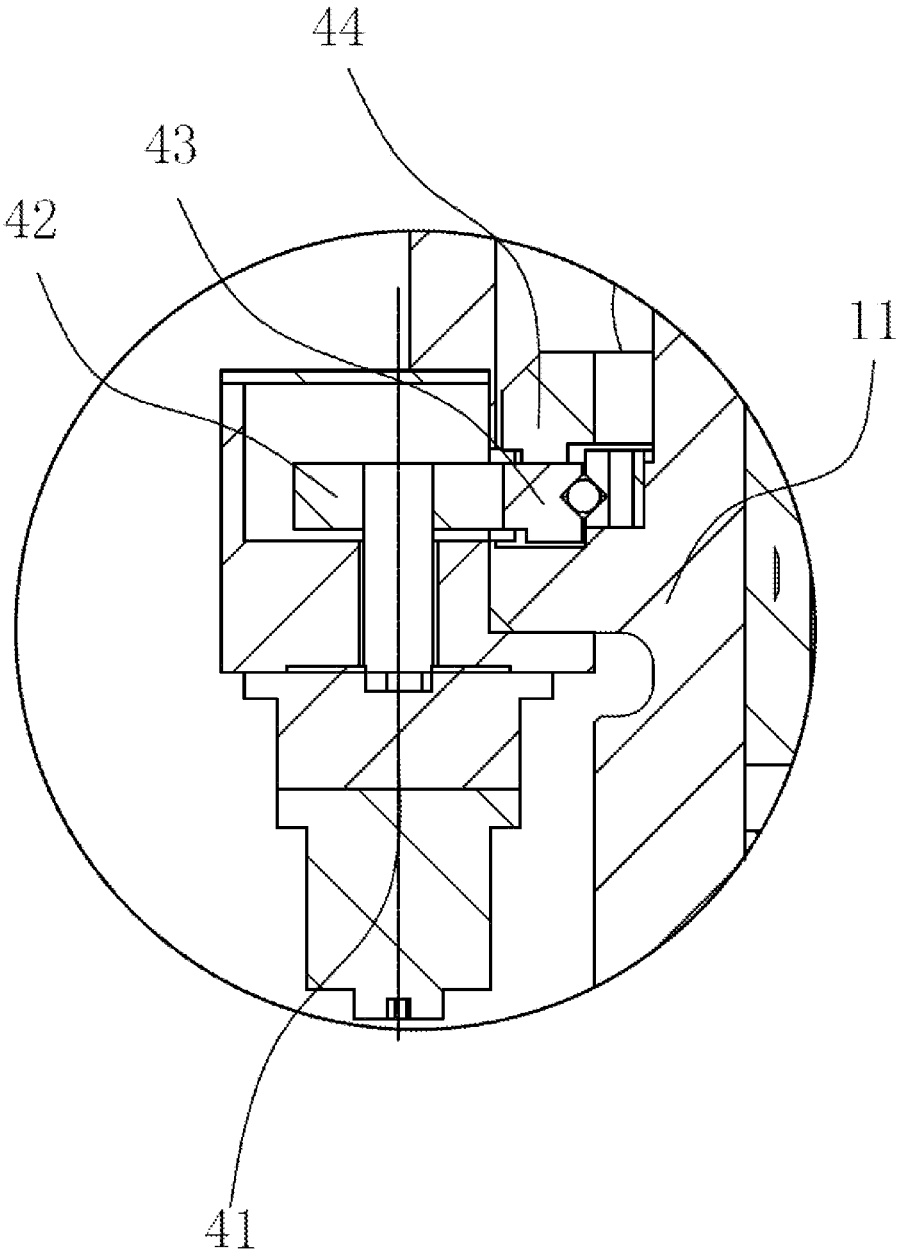
FIG. 9 is a partially schematic view of A shown in FIG. 9.

In the embodiment, a first bearing is fixedly provided on the body 11. The first bearing includes an inner race fixedly connected to the body 11, and an outer race being the swing gear 43. As shown in FIG. 9, the inner race of the bearing is fixedly provided on the body 11. The outer race of the bearing is the swing gear 43. In the embodiment, the swing gear 43 and the bevel gear 44 are two components. In installation, the bevel gear 44 is fixed fittingly above the swing gear 43, as shown in the figure. In a specific embodiment, the swing gear 43 and the bevel gear 44 may also be an integrated structure of a same component, and the bevel gear 44 is directly provided above the swing gear 43. In the embodiment, the swing gear 43 is a circle of gears on an outer surface of the outer race of the bearing. This realizes engaged transmission between the pinion 42 and the swing gear 43.

Figure 10:
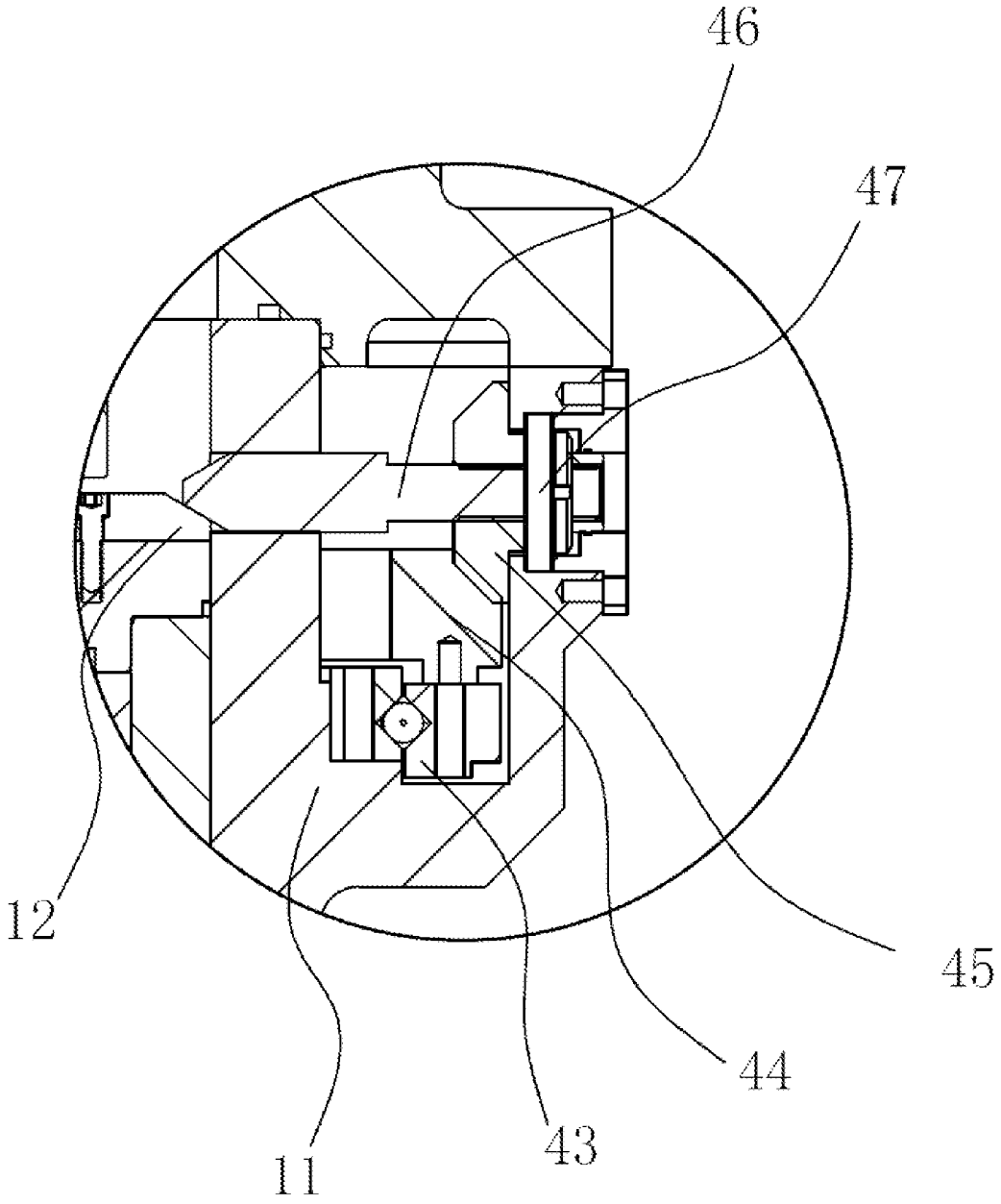
FIG. 10 is a partially schematic view of B shown in FIG. 9.

As shown in FIG. 10, one end of the compression part 46 is provided with an outer thread. The cone gear 45 is provided with an inner thread, and fixedly connected to the body 11 through second bearing 47. The outer thread and the inner thread are engaged and are in screwed driving connection. The other end (a left end shown in the figure) of the compression part 46 passes through the body 11 and is slidably connected to the body. The other end of the compression part 46 is a polygonal structure. A polygonal through hole for passing through the compression part 46 is also formed in the body 11 and corresponding to the compression part. In the figure, the compression part 46 compresses the rotating sealing assembly.

In the embodiment, there are four equally spaced compression parts 46, and four equally spaced second bearings 47 matching with the compression parts in FIG. 10. This equalizes a pressure of the compression part 46 on the rotating sealing assembly, and makes compression more reliable. In a specific embodiment, according to an actual well control condition, more compression parts 46 may be provided as required.

In the embodiment, the compression mechanism 4 works as follows: Before placement of the rotating sealing assembly 12, the compression part 46 is located in the body 11, and does not extend out of the inner surface of the bore through hole. The rotating sealing assembly 12 is placed into the body 11 from an upward side of the bore through hole. When the rotating sealing assembly gets to a preset position, the single-output actuator 41 drives the pinion 42 connected to the output end of the single-output actuator 41 to rotate. The pinion 42 is in transmission connection with the swing gear 43, and drives the bevel gear 44 to rotate. The bevel gear 44 drives four cone gears 45 to rotate. In response to rotation of the cone gears 45, the compression part 46 threadedly connected to each of the cone gears makes relative movement in a horizontal direction in the figure. Since the cone gear 45 is fixed on the body 11 through the second bearing 47, the cone gear 45 does not move in the horizontal direction in the figure, and the compression part 46 moves toward a center of the body 11. Therefore, the rotating sealing assembly 12 is pressed downward in the figure in an axial direction of the body 11. When the rotating sealing assembly 12 is to be taken out, the single-output actuator 41 controls the compression part 46 to retract into the body 11.

Figure 11:
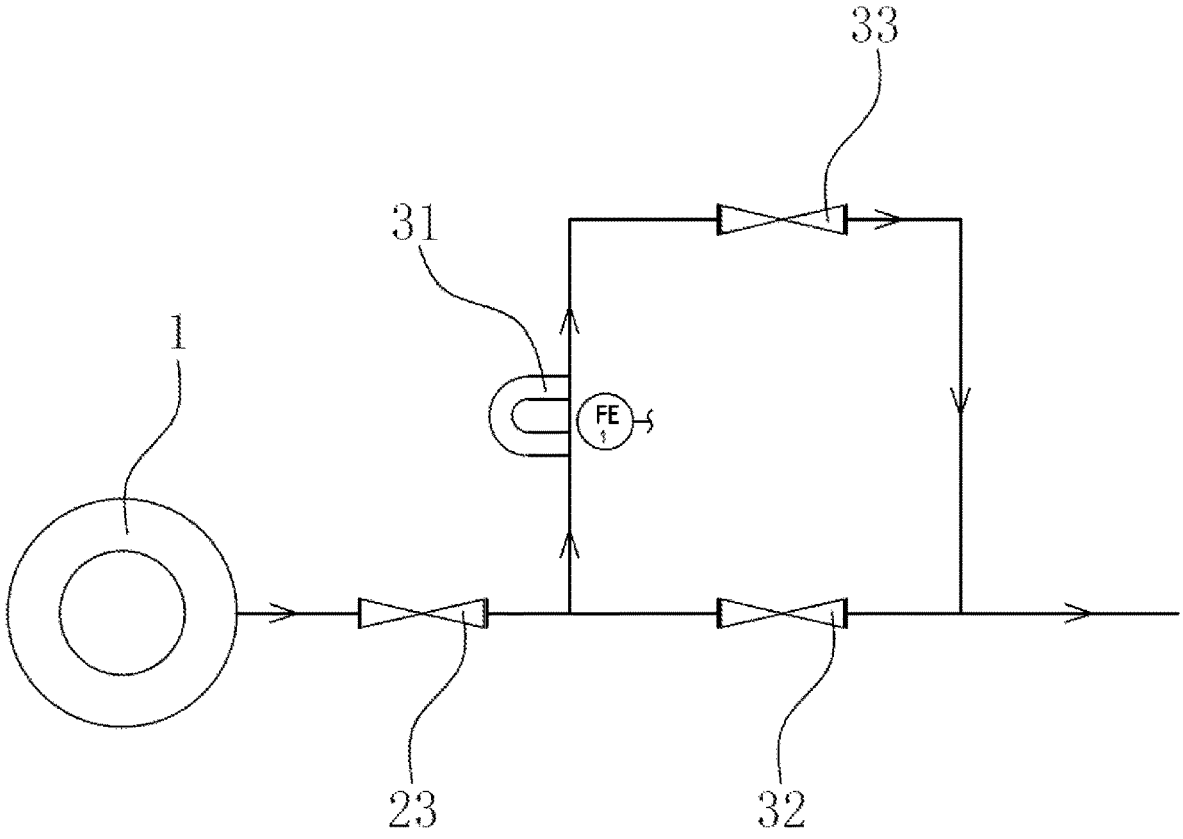
FIG. 11 illustrates a flowchart of a first working state according to Embodiment 1.

FIG. 11 illustrates a flowchart of a first working state in Embodiment 1, namely a flowchart of flow detection of the multifunctional RCD. As shown in the figure, in response to the flow detection, the straight-through cut-off valve 23 is turned on, the first flow cut-off valve 32 is turned off, and the second flow cut-off valve 33 is turned on. A fluid flows out from the output end of the second flow cut-off valve 33 through the flowmeter 31. The fluid in a flow channel flows to an arrow direction in the figure, thereby realizing the flow detection on the fluid.

Figure 12:
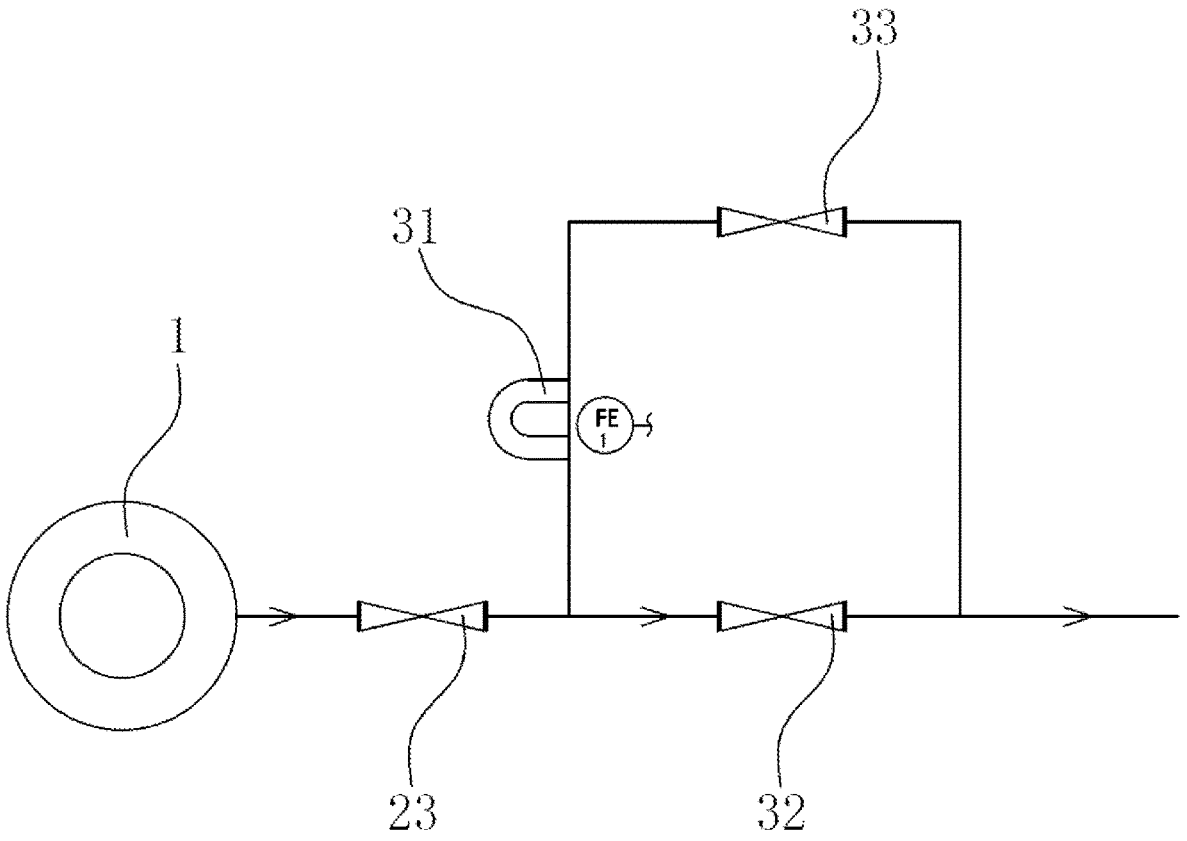
FIG. 12 illustrates a flowchart of a second working state according to Embodiment 1.

FIG. 12 illustrates a flowchart of a second working state in Embodiment 1, namely the flow detection is not performed by the multifunctional RCD. The straight-through cut-off valve 23 is turned on, the first flow cut-off valve 32 is turned on, and the second flow cut-off valve 33 is turned off. A fluid does not pass through the flowmeter 31. The fluid in a flow channel flows to an arrow direction in the figure, and directly flows out from the output end of the first flow cut-off valve 32.

In the embodiment, the double-output actuator has an electric driving structure. A manual driving mechanism may also be provided. In case of a failure or a fault of the electric driving structure, the manual driving mechanism can ensure normal work of the system.

In the embodiment, a through hole for passing through the compression part 46 is formed in the body 11. The compression part 46 may be non-circular according to an actual use condition to prevent rotation of the compression part 46.

In the embodiment of the present disclosure, the straight-through cut-off valve 23, the first flow cut-off valve 32, the inlet of the flowmeter 31 and the connector 2 are an integrated structure. That is, the above components are combined together, and this makes the structure more compact, and the size smaller. Meanwhile, in specific application, the above components may be a split structure according to an actual condition.

In this embodiment, all cut-off valves are the type of plug valve. In a specific embodiment, other types of cut-off valves such as gate valve, ball valve, etc., can be selected according to specific use conditions.

The above described are merely preferred embodiments of the present disclosure, which are not intended to limit the present disclosure. Any modifications, equivalent replacements and improvements made within the spirit and principle of the present disclosure should be included in the protection scope of the present disclosure.

What is claimed is:

1. A multifunctional rotating control device (RCD), comprising an RCD assembly and a flow detection module, wherein the RCD assembly comprises a body and a rotating sealing assembly; a bore through hole and a bypass outlet are formed in the body; the rotating sealing assembly is provided in the bore through hole; and the bypass outlet is connected to a straight-through cut-off valve; and the flow detection module comprises a flowmeter, a first flow cut-off valve, and a second flow cut-off valve; the flowmeter extends upward in a direction of the bore through hole; the first flow cut-off valve and the second flow cut-off valve are respectively provided at two ends of the flowmeter, and communicate with the flowmeter; an inlet of the flowmeter is a flow detection input outlet; the flow detection input outlet communicates with the straight-through cut-off valve; and an outlet of the second flow cut-off valve is a flow detection output outlet.

2. The multifunctional RCD according to claim 1, wherein the first flow cut-off valve and the second flow cut-off valve are opposite to each other; and a double-output actuator is provided between the first flow cut-off valve and the second flow cut-off valve and configured to drive a first one of the first flow cut-off valve and the second flow cut-off valve to turn on and a second one of the first flow cut-off valve and the second flow cut-off valve to turn off.

3. The multifunctional RCD according to claim 1, wherein the multifunctional RCD further comprises a compression mechanism for compressing the rotating sealing assembly; and the compression mechanism is provided on the body.

4. The multifunctional RCD according to claim 3, wherein the compression mechanism comprises a compression part and a driving mechanism; and the driving mechanism drives the compression part to extend out of an inner surface of the body or retract into the body.

5. The multifunctional RCD according to claim 4, wherein the driving mechanism comprises a single-output actuator and a transmission mechanism; the transmission mechanism comprises a pinion, a swing gear, and cone gears; an output shaft of the single-output actuator is fixedly connected to the pinion; the swing gear is sleeved on an outer side of the body; an external gear is in transmission connection with the pinion and is provided at an outer side of the swing gear; a bevel gear is in transmission connection with a plurality of the cone gears and is provided on a top of the swing gear; and the cone gears each are in screwed driving connection with the compression part.

6. The multifunctional RCD according to claim 5, wherein a first bearing is fixedly provided on the body; and the first bearing comprises an inner race fixedly connected to the body, and an outer race being the swing gear.

7. The multifunctional RCD according to claim 6, wherein a first end of the compression part is provided with an outer thread; the cone gear is provided with an inner thread, and fixedly connected to the body through a second bearing; and the outer thread and the inner thread are engaged and are in screwed driving connection.

8. The multifunctional RCD according to claim 7, wherein a second end of the compression part passes through the body and is slidably connected to the body.

9. The multifunctional RCD according to claim 8, wherein a non-circular hole is formed in the body; and the compression part is provided with a structure matching with the non-circular hole, and the compression part is slidably connected to the structure matching with the non-circular hole.

10. The multifunctional RCD according to claim 4, wherein there are a plurality of compression pans, the plurality of compression parts are equally spaced in a circumferential direction of the body.

11. The multifunctional RCD according to claim 2, wherein the multifunctional RCD further comprises a compression mechanism for compressing the rotating sealing assembly; and the compression mechanism is provided on the body.

12. The multifunctional RCD according to claim 11, wherein the compression mechanism comprises a compression part and a driving mechanism; and the driving mechanism drives the compression part to extend out of an inner surface of the body or retract into the body.

13. The multifunctional RCD according to claim 12, wherein the driving mechanism comprises a single-output actuator and a transmission mechanism; the transmission mechanism comprises a pinion, a swing gear, and cone gears; an output shaft of the single-output actuator is fixedly connected to the pinion; the swing gear is sleeved on an outer side of the body; an external gear is in transmission connection with the pinion and is provided at an outer side of the swing gear; a bevel gear is in transmission connection with a plurality of the cone gears and is provided on a top of the swing gear; and the cone gears each are in screwed driving connection with the compression part.

14. The multifunctional RCD according to claim 13, wherein a first bearing is fixedly provided on the body; and the first bearing comprises an inner race fixedly connected to the body, and an outer race being the swing gear.

15. The multifunctional RCD according to claim 14, wherein a first end of the compression part is provided with an outer thread; the cone gear is provided with an inner thread, and fixedly connected to the body through a second bearing; and the outer thread and the inner thread are engaged and are in screwed driving connection.

16. The multifunctional RCD according to claim 15, wherein a second end of the compression part passes through the body and is slidably connected to the body.

17. The multifunctional RCD according to claim 16, wherein a non-circular hole is formed in the body; and the compression part is provided with a structure matching with the non-circular hole, and the compression part is slidably connected to the structure matching with the non-circular hole.

18. The multifunctional RCD according to claim 12, wherein there are a plurality of compression parts, the plurality of compression parts are equally spaced in a circumferential direction of the body.

* * * * *